US005140970A

United States Patent [19]

Akaki et al.

[11] Patent Number: 5,140,970

[45] Date of Patent: Aug. 25, 1992

[54] IGNITION CONTROLLING DEVICE

[75] Inventors: Motonobu Akaki, Anjo; Nobuyuki Oota, Kariya; Yasutoshi Yamada, Aichi, all of Japan

[73] Assignee: Aisin Seiki Kabushiki Kaisha, Kariya, Japan

[21] Appl. No.: 717,658

[22] Filed: Jun. 19, 1991

[30] Foreign Application Priority Data

Jun. 20, 1990 [JP] Japan ..... 2-159928

[51] Int. Cl.[5] ..... F02P 3/04

[52] U.S. Cl. ..... 123/620; 123/637; 123/640; 123/644

[58] Field of Search ..... 123/620, 637, 640, 644

[56] References Cited

U.S. PATENT DOCUMENTS 3,280,809 10/1966 Issler ..... 123/637 X
3,919,993 11/1975 Neuman ..... 123/620
4,183,340 1/1980 Gilbert ..... 123/620 X
4,709,684 12/1987 Kaiser et al. ..... 123/644

FOREIGN PATENT DOCUMENTS 50273 3/1985 Japan ..... 123/640
1501621 2/1978 United Kingdom ..... 123/637
2087483 5/1982 United Kingdom ..... 123/640

*Primary Examiner*—Tony M. Argenbright
*Attorney, Agent, or Firm*—Oblon, Spivak, McClelland, Maier & Neustadt

[57] ABSTRACT

An ignition controlling device includes a spark plug, a first ignition coil for supplying an ignition current to the spark plug, a second ignition coil for supplying an ignition current to the spark plug and a controller for controlling the supplies of the currents to the spark plug from the first and second ignition coils.

9 Claims, 10 Drawing Sheets

OUTPUT WAVE SHAPE CHANGING: CHOICE 1

OUTPUT WAVE SHAPE CHANGING: CHOICE 2

OUTPUT WAVE SHAPE CHANGING: CHOICE 1
OUTPUT WAVE SHAPES WHEN THE FIRST IGNITION COIL 2A IS IN CUT-OFF CONDITION

OUTPUT WAVE SHAPE CHANGING: CHOICE 1
OUTPUT WAVE SHAPES WHEN THE SECOND IGNITION COIL 2B IS IN CUT-OFF CONDITION

OUTPUT WAVE SHAPE CHANGING: CHOICE 2
OUTPUT WAVE SHAPES WHEN THE SECOND IGNITION COIL 2B IS IN CUT-OFF CONDITION

OUTPUT WAVE SHAPE CHANGING: CHOICE 2
OUTPUT WAVE SHAPES WHEN THE FIRST IGNITION COIL 2A IS IN CUT-OFF CONDITION

IGNITION CONTROLLING DEVICE

BACKGROUND OF THE INVENTION

The present invention relates to an ignition controlling device for an internal combustion engine.

Conventionally, misfire may occur in the ignition procedure. In such case, a subsequent ignition or discharging should be retried. A device for enabling the successive ignitions or dischargings is disclosed in Japanese Patent Laid-open Print No. 50-58430 published in 1975 without examination. Similar device is also disclosed in Japanese Patent Laid-open Print No. 57-28871 published in 1982 without examination.

However, despite the proposal of the foregoing devices, neither device can prevent misfire per se in the ignition procedure.

SUMMARY OF THE INVENTION

It is, therefore, a primary object of the present invention to provide an ignition controlling device without the foregoing drawback.

It is another object of the present invention to provide an ignition controlling device by which misfire can be prevented.

To achieve the objects and in accordance with the purposes of the present invention, an ignition controlling device comprises a spark plug, a first ignition coil for supplying an ignition current to the spark plug, a second ignition coil for supplying an ignition current to the spark plug and a controller for controlling the supplies of the currents to the spark plug from the first and second ignition coils.

BRIEF DESCRIPTION OF THE DRAWINGS

The above and other objects, features and advantages of the present invention will become more apparent and more readily appreciated from the following detailed description of preferred exemplary embodiments of the present invention, taken in connection with the accompanying drawings, wherein.

DETAILED DESCRIPTION OF THE PREFERRED EMBODIMENT

Hereinafter, one embodiment of an ignition control device for an internal combustion engine according to the present invention will be described with reference to the drawings.

Figure 1:
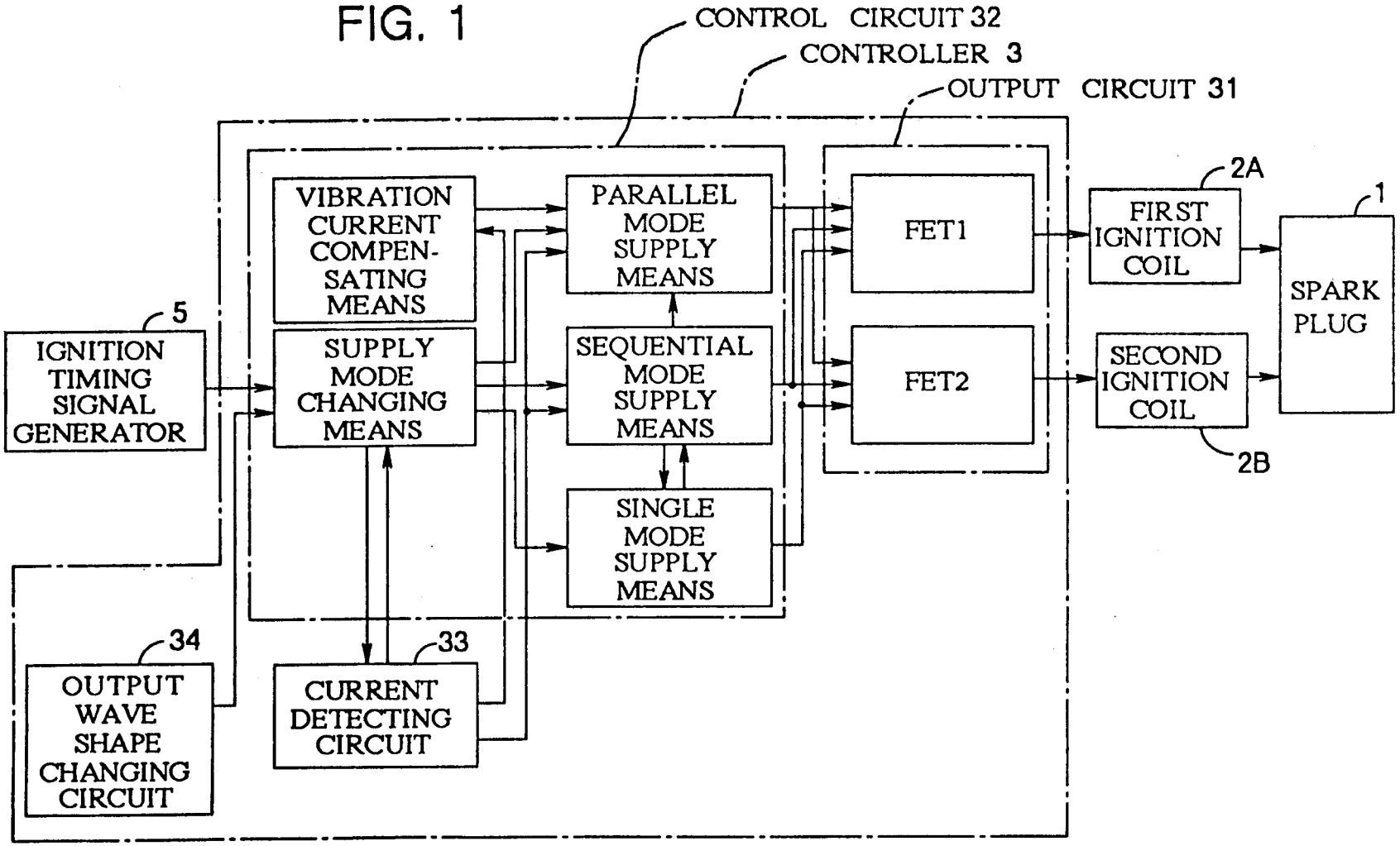
FIG. 1 is a block diagram of an ignition device for an internal combustion engine.
Figure 2:
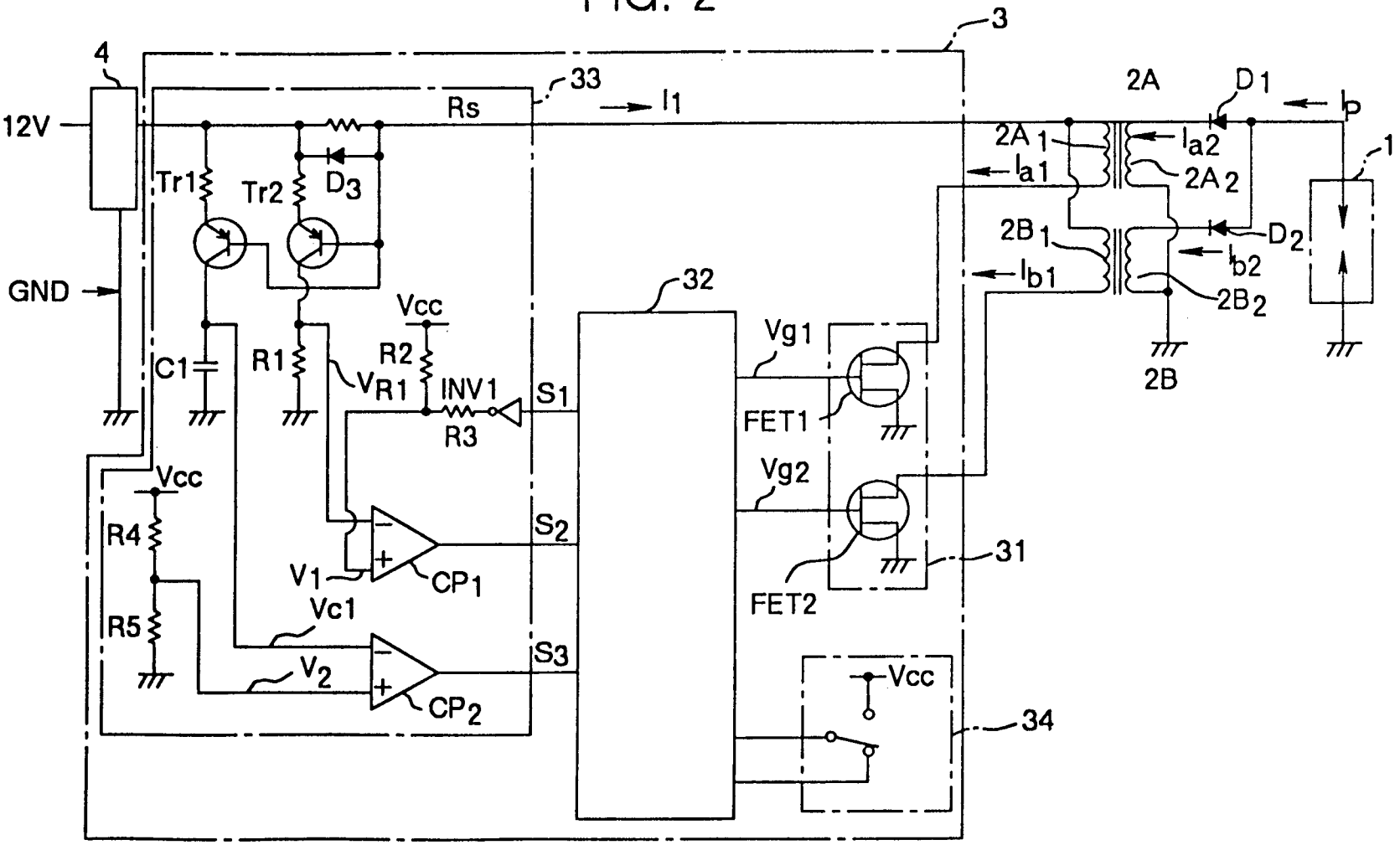
FIG. 2 is an electric circuit of an ignition device shown in FIG. 1.

FIG. 1 and FIG. 2 show a block diagram and an electric circuit of an ignition device respectively in which the ignition control device is included.

Referring first to FIG. 1, the ignition control device has a first coil 2A, a second coil 2B and a controller 3 and is designed to supply an amount of electric current to an ignition plug or a spark plug 1 via the ignition coils 2A and 2B upon receipt of a signal from an ignition timing signal generator 5. The controller 3 has an output wave shape changing circuit 34, a control circuit 32 and an output circuit 31.

Referring next to FIG. 2, one pole of the plug 1 is electrically connected to one end of a secondary winding 2A1 of the first ignition coil 2A and one end of a secondary winding 2B1 of the second ignition coil 2B via a diode D1 and a diode D2 respectively. The other pole of the plug 1 is grounded. The other end of the secondary winding 2A2 (2B2) of the first ignition coil 2A (the second ignition coil 2B) is grounded.

A primary current Ia1 (Ib1) of the coil 2A (2B) is supplied from a common DC—DC converter 4 via the controller 3. An input voltage of DC 12 volts is converted therethrough into an output voltage ranging from DC 50 volts through DC 100 volts. The primary currents Ia1 and Ib1 flowing through the primary winding 2A1 of the first ignition coil 2A and the primary winding 2B1 of the second ignition coil 2B respectively are deemed as magnetic energies and are designed to be controlled by a first electric field effect transistor FET1 and a second electric field effect transistor FET2 respectively both of which constitute the output circuit 31 of the controller 3. A signal regarding an output current of the controller 3 which is the summation of the currents Ia1 and Ib1 is to be detected by a current detecting circuit 33 which is a component or element of the controller 3.

The current detecting circuit 33 includes a PNP transistor Tr2 for detecting an output current value signal VR1 corresponding to the output current I1 of the controller 3 and another PNP transistor Tr1 for detecting an output current integration value signal Vc1 corresponding to the time integration value of the output current I1 each time it flows. The output current value signal VR1 is to be detected as a terminal voltage of a collector output register R1 of the PNP transistor Tr2 and the output current integral value signal VC1 is to be detected as a terminal voltage of an integration capacitor C1 connected to a collector of other PNP transistor Tr2. The signal VR1 (VC1) is to be inputted to a reversed phase input terminal of a first comparator CP1 (a second comparator CP2). A normal phase input terminal of the first comparator CP1 is to be provided with a comparative voltage level V1 in the form of a high voltage level VH or a lower voltage level VL which represents respectively a high level or a low level of a condition of an output signal S1 derived from the control circuit 32 of the controller 3 via an inverter INV1. A normal phase input terminal of the second comparator CP2 is to be inputted with a second comparative voltage level V2 which depends on a resistor R4 and a resistor R5. The control circuit 32 is designed to be provided with a manually selected signal which indicates either "first choice" or "second choice" and output signal voltages Vg1 and Vg2 to the transistors FET1 and FET2, respectively. As described previously, the foregoing signal S1, which is determined in relation to voltages supplied to gates of the transistors FET1 and FET2, respectively, is to be outputted from the control circuit 32 to the inverter INV1 of the current detecting circuit 33, and the output signals S2 and S3 from the respective comparators CP1 and CP2 are inputted to the control circuit 32.

The following ignition current control will be established by means of the foregoing ignition control device having two ignition coils which is one embodiment of the present invention.

Figure 3:
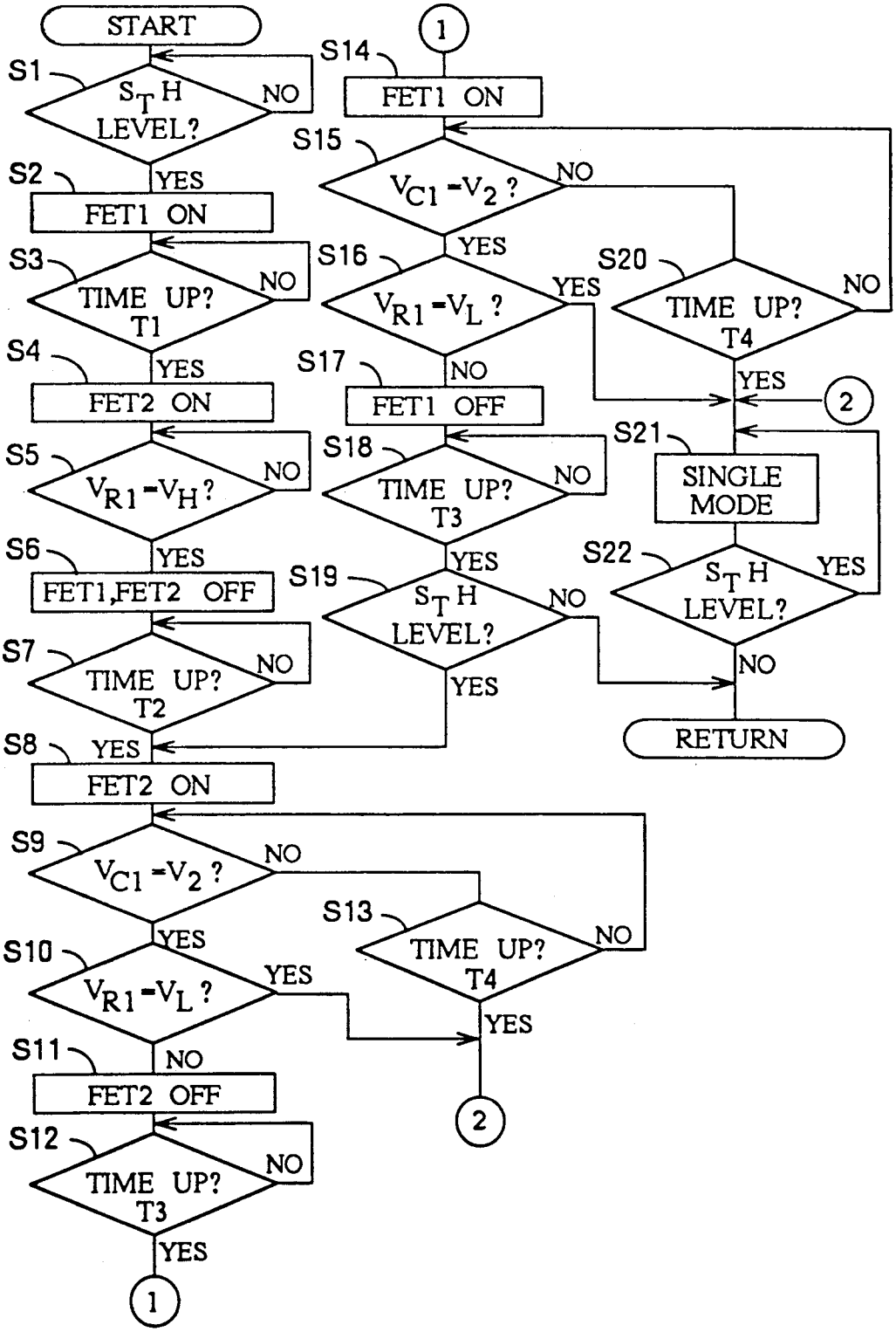
FIG. 3 is a flowchart showing a operation of an output wave changing circuit when it is under a first choice.
Figure 4:
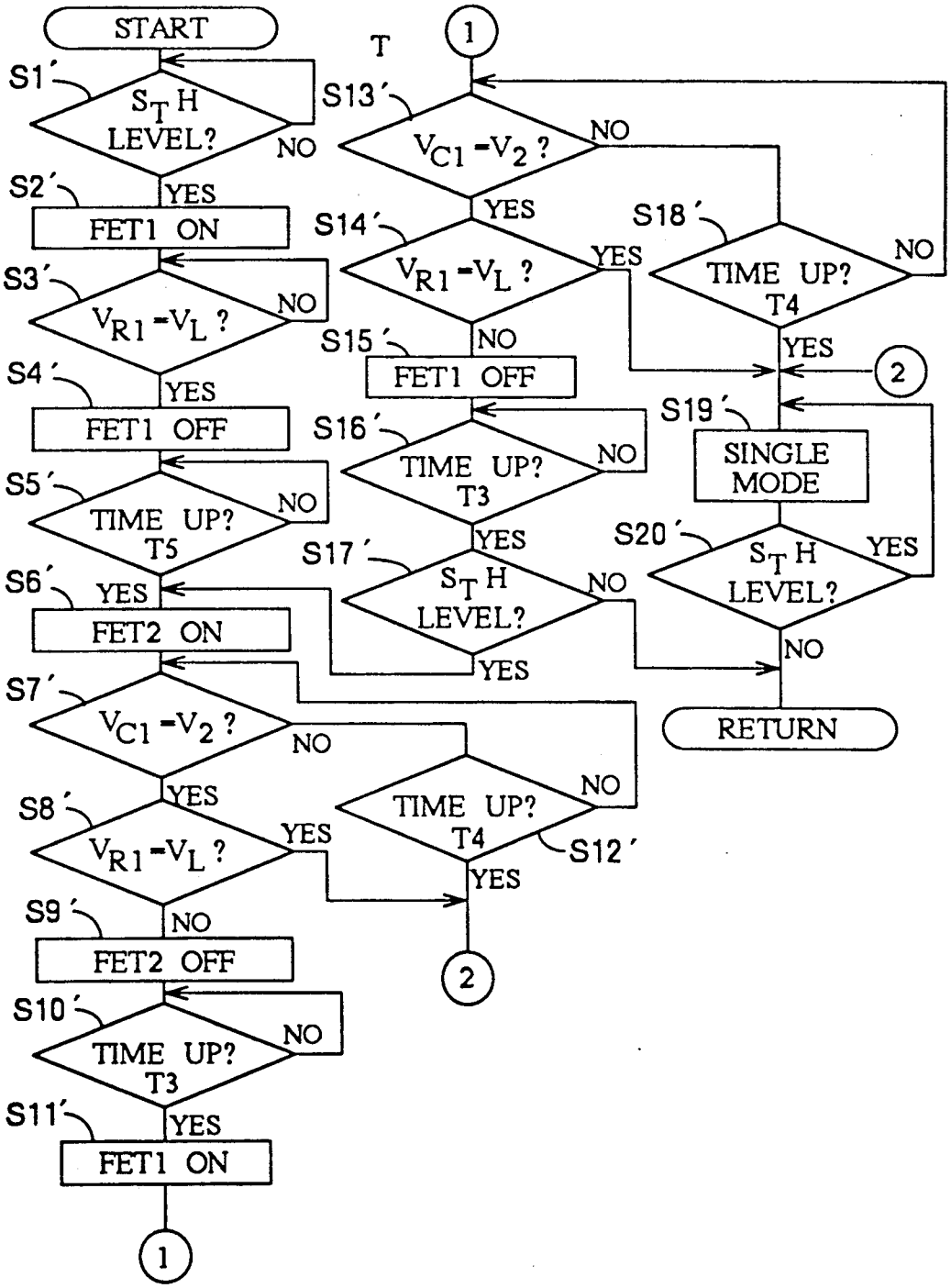
FIG. 4 is a similar view to FIG. 3 but an output wave changing circuit is under a second choice.
Figure 5:
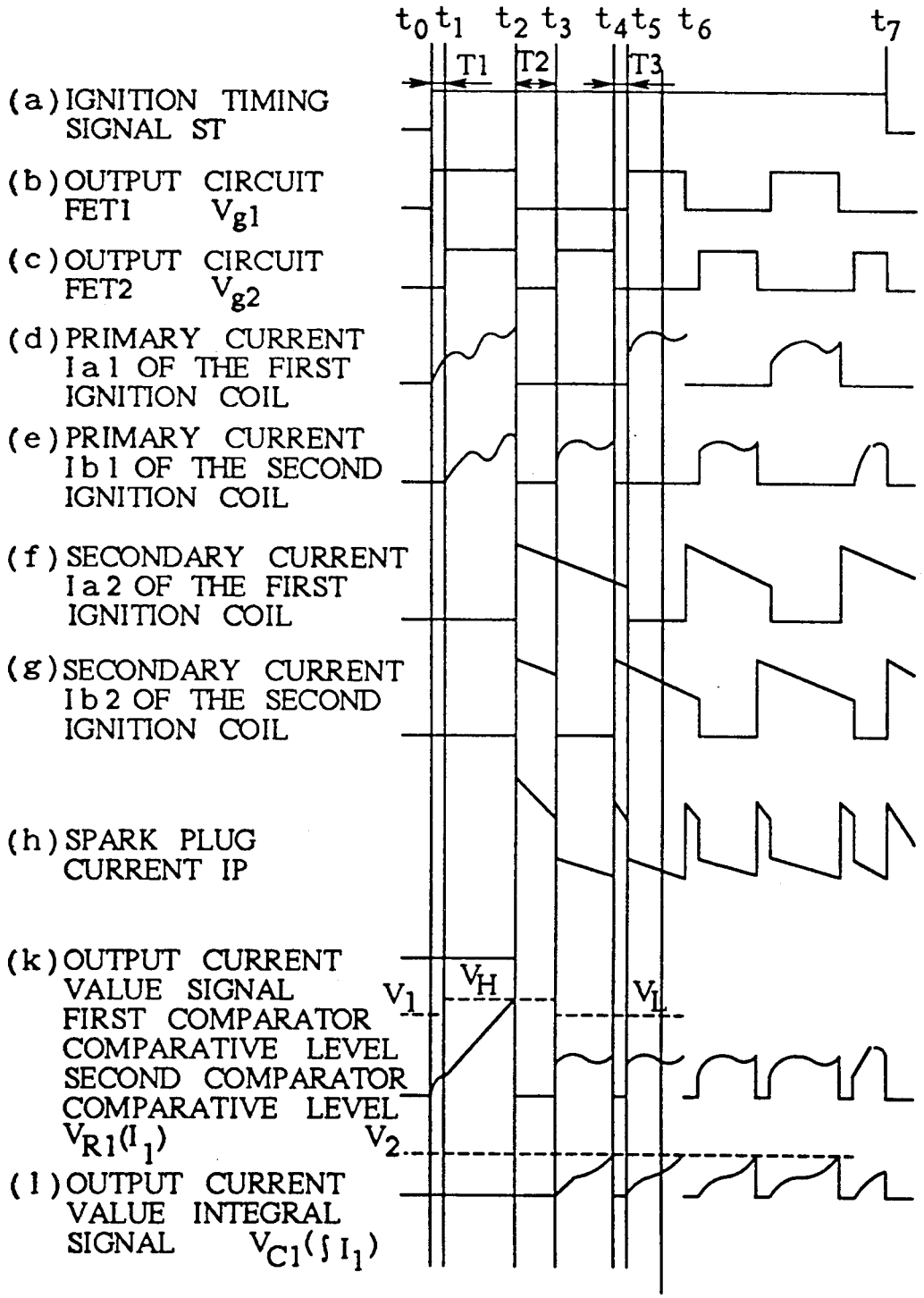
FIGS. 5(a-h, k and l) show each signal's timing chart under a first choice.
Figure 6:
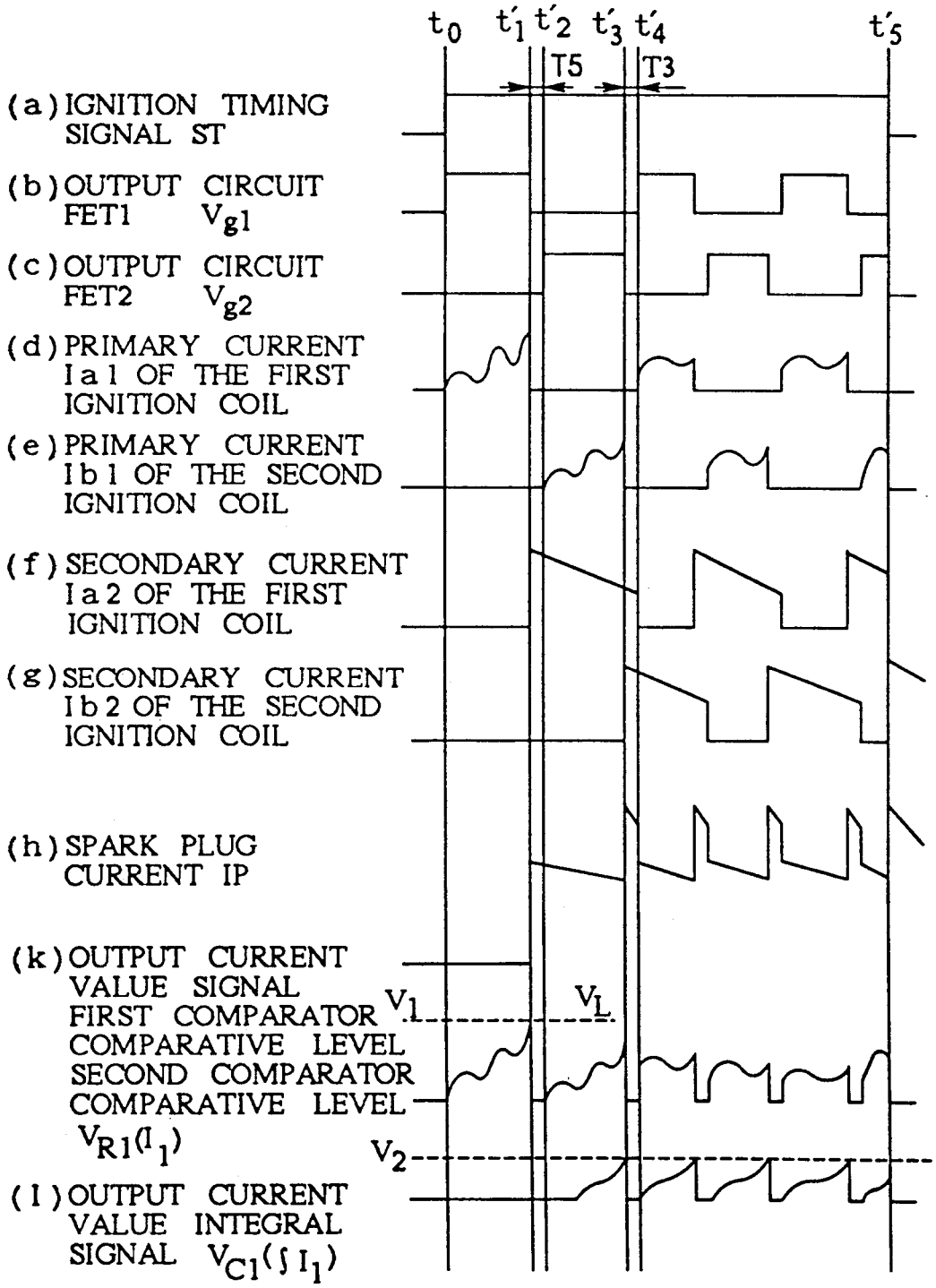
FIGS. 6(a-h, k and l) show each signal's timing chart under a second choice.

FIG. 3 and FIG. 5 are a flow chart and a signal timing chart respectively when "first choice" is selected in the output wave shape changing circuit 34.

In FIGS. 3 and 5, when an ignition timing signal ST becomes 'H' which means a high level or ON condition at a time tO, after a parallel mode supply means is selected by a supply mode changing means in the controller 3, first of all the transistor FET1 is switched on, thereby flowing the primary current Ia1 as an urging current through the primary winding 2A1 of the first ignition coil 2A (step s2). The resultant primary current Ia1 is of an type and a vibrational wave form as seen from FIG. 5 is produced. After a time elapse of T1 (step s3), at a time t1, the transistor FET2 is switched on, thereby flowing the primary current Ib1 through the primary winding 2B1 of the second ignition coil 2b (step s4).

The set time by the timer T1 has been previously set to a half of proper vibration number of the primary winding of the ignition coil and is between multi microseconds and multi deca microseconds, for example. Both of the primary currents Ia1 and Ib1 are substantially identical in wave shape and are out of phase by a half in proper vibration number of circuit, resulting in that a substantial linear increase of the output current I1 from the controller 3 depending on the time constant which is the summation of these currents which leads a linear increase of the output current value signal VR1.

It should be noted that the compensation of the vibration current is available not only under the control in the parallel mode in the following step 6 but also upon a first supply of the primary current after issue of the ignition signal under a sequential mode control in 'second choice' which will be detailed later.

If the output current I1 becomes a set value which is the summation of the primary currents of both ignition coils, the output current value signal VR1 becomes VH level (step s5) after the voltage level V1 at the normal input terminal of the first comparator CP1 is transferred from the level VL to the level VH due to 'H' of the output signal S1 from the control circuit 32 simultaneous with the beginning of the flowing of the primary current through the second ignition coil 2B. At this time, each of the ignition coils "a and "b is of sufficient energy, at a time t2 simultaneous openings of both transistors FET1 and FET2 are established and secondary currents Ia2 and Ib2 from the secondary windings 2A2 and 2B2 of both ignition coils respectively to the spark plug 1 (step s6), thereby establishing the supply of the ignition current by means of parallel mode supply means.

Under the parallel mode, a spark current IP at the spark plug 1 is equal to the summation of the secondary currents Ia2 and Ib2 from the respective ignition coils 2A and 2B, thereby becoming the spark current IP of an extremely large one. Thus, a sufficient discharge energy is being supplied into the combustion chamber in the engine which enables quick or immediate ignition.

When a time of T2 has elapsed after the ignition of the spark plug 1 (step s7), the supply mode changing means of the control circuit begins to select a sequential mode supply means. That is to say, at a time of t3 the transistor FET2 is brought into switched on condition (step s8), the ignition current IP becomes being of the secondary current Ia2 from the first ignition coil. As the time T2, any value ranging from multi hundred microseconds through multi deca microseconds is available and in this embodiment 64 microseconds is employed. As a result of the transfer to the sequential mode, the energy supply to the primary winding of the second ignition coil 2B is established so as to serve for the preparation of the coming next ignition current supply therefrom, and the output, current I1 from the controller 3 is equal to the primary current Ib1 of the second ignition coil 2B. At this time, since the second ignition coil 2B has remained with the energy stored at the last current supply therethrough, only a short-time supply of a primary current Ib1 is enough to accumulate the energy in the second ignition coil 2B.

The primary current Ib1 of the second ignition coil 2B or the output current integral value signal VC1 corresponding to the output current I1 from the controller 3 becomes a set value of V2 (step s9), at a time t4, the primary current Ib1 of the second ignition coil 2B is brought into interruption, resulting in that an overlapping duration is established wherein the secondary current Ib2 from the secondary winding 2B2 of the second ignition coil 2B as the large spark current IP after being again added with the ignition current from the first ignition coil 2A is supplied to the spark plug 1 (step s11).

Prior to the interruption of the primary current Ib1 of the second ignition coil 2B, the comparative voltage level V1 at the normal phase input terminal of the first comparator CP1 has been lowered to the level VL for detecting the short-circuit of one of the ignition coils, and in the event of the lowering of the output current value signal VR1 to this level, which is regarded as a short-circuit failure of the second ignition coil 2B by the controller 3 (step s1O) with the result that a single mode supply means is selected by the supply mode changing means. Thus, thereafter, a mult-ignition system is employed which is based on the ignition only by the first ignition coil 2A. In addition, if the output current integral value signal VC1 can't reach the level V2 within a time of T4, the second ignition coil 2B is deemed to be its cut-off failure (step s13) which brings the transfer to the single mode.

When a time of T3 has elapsed after the beginning of the overlapping duration (step s13), the transistor FET1 is switched on and the secondary current Ib2 from the second ignition coil 2B consists only of the spark current IP. The time T3 is so set to obtain enough time for initiate the current supply from the second ignition coil to the spark plug and the T3 overlapping duration enables the prevention of the misfire of the spark plug 1. As the overlapping duration, any one value between multi microseconds and multi deca microseconds is available, such as 8 microseconds.

At a time t5 after termination of the overlapping duration, similar to the forementioned second ignition coil 2B, the first ignition coil 2A is continued to be energized until the output current value signal VR1 is lowered to the level VL. After an amount of the energy has been stored in the first ignition coil 2A, at a time t6, the switching off of the transistor FET1 of the output circuit 31 is established and the overlapping duration begins to proceed again under which the supply of the ignition current to the spark plug 1 from both of the ignition coils 2A and 2B (step s17). Further, each of the first ignition coil 2A and the second ignition coil 2B continues to supply the ignition current to the spark plug 1 in such a manner that during this supply one or more overlapping durations are occurred. This supply of the ignition current will be terminated upon lowering transfer of the ignition timing signal ST to the level L. Then, the engine moves to the exhaust stoke which follows the explosion stroke.

Similar to FIG. 3 and FIG. 5, FIG. 4 and FIG. 6 show a flow chart and a signal timing chart respectively when "second choice" is selected in the output wave shape changing circuit 34.

A sequential mode under "second choice" is so operated similar to that under "first choice" that detailed description will be omitted. It is noted that the comparative voltage level V1 at the comparator CP1 is set to be a specific value which is equal to the level VL upon one ignition coil as previously mentioned and is used for detecting the short-circuit failure of the ignition coil similar to under "first choice" except that it serves for detecting a level of the initial output current upon issue of the ignition timing signal ST. In the sequential mode under "second choice", similar to that under "first choice", an overlapping duration of 8 microseconds for example between a time t3' and a time t4' is provided, thereby eliminating the fear of the misfire of the spark plug 1. Thus, a continuous supply of the ignition current for any desired duration is provided.

FIGS. 7 through 10, as specified in the respective figures, show timing charts when the first ignition coil 2A or the second ignition coil 2B is in the cut-off failure under the manual selection is "first choice" or "second choice". In case of the cut-off failure or the short-circuit failure of each of the ignition coils 2A and 2B, since the sequential mode control is not available, the mult-ignition system operates in such a manner that only the functional ignition coil is to be controlled by the output current integral value signal VC1 and the timer is set to be 250 microseconds.

Figure 7:
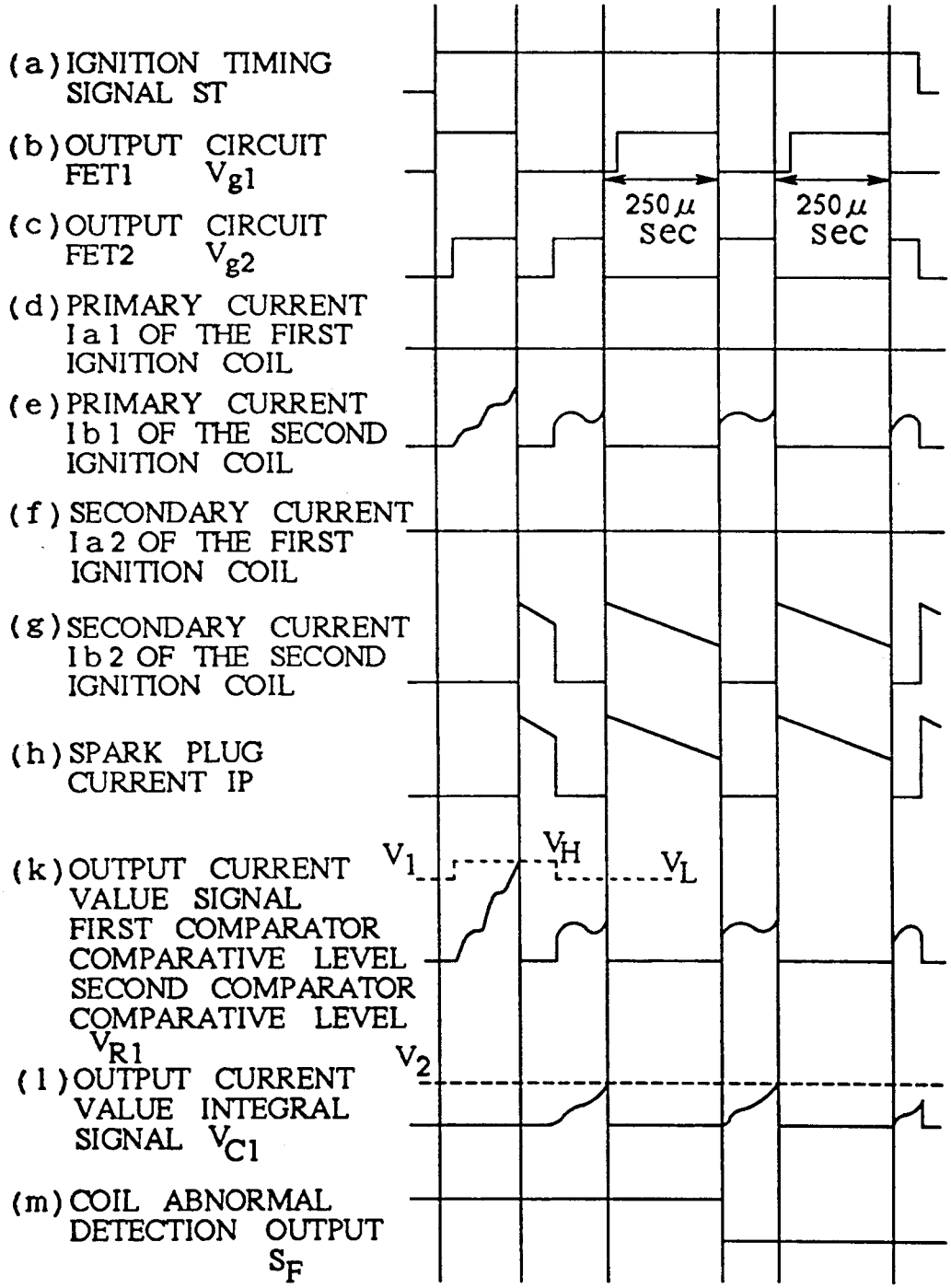
FIGS. 7(a-h, k, l and m), 8(a-h, k, l and m), 9(a-h, k, l and m) and 10(a-h, k, l and m) show timing charts when one of the ignition coils is in a cut-off condition when an output wave changing circuit is under a first choice or a second choice.
Figure 8:
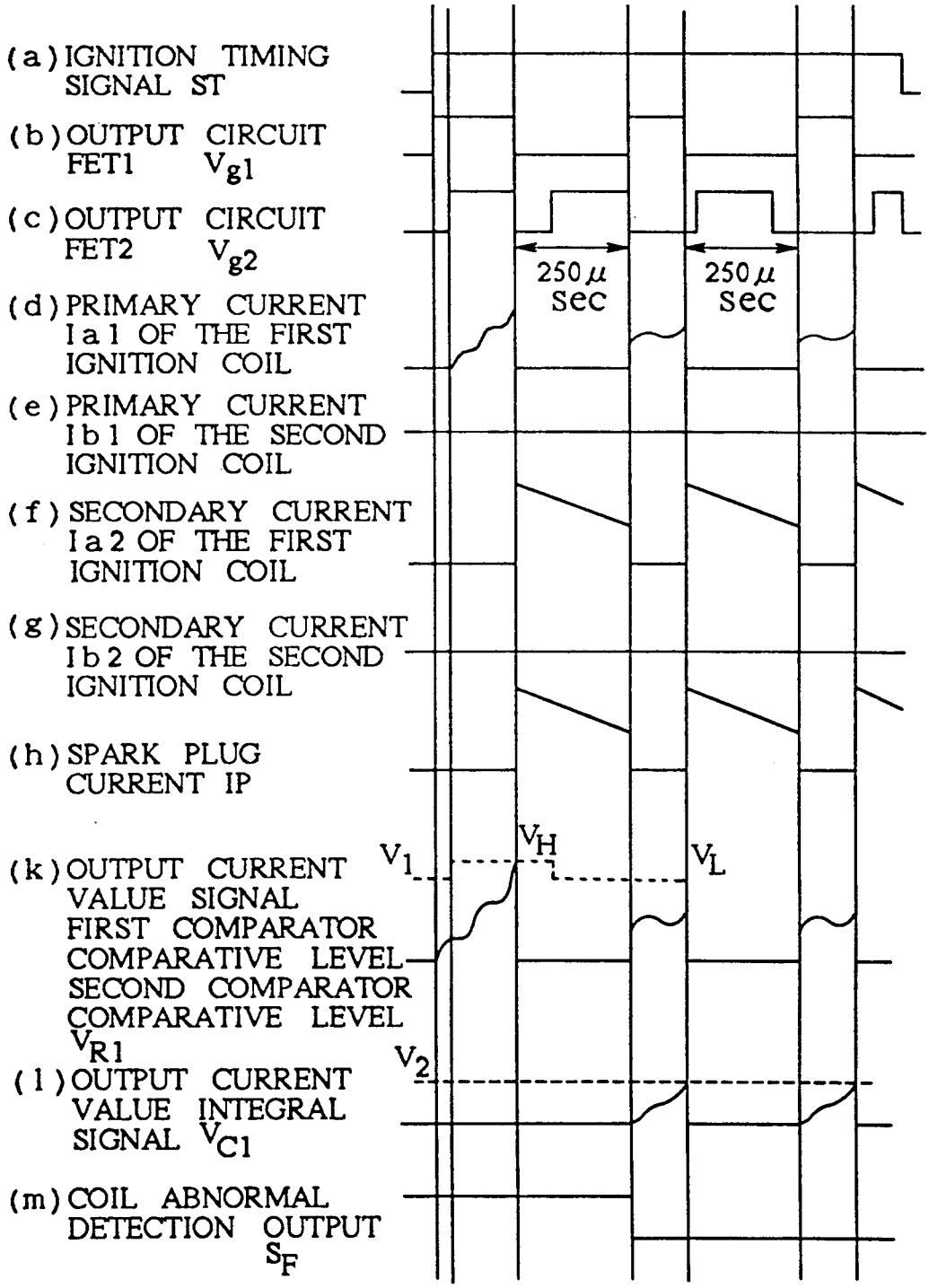
Figure 9:
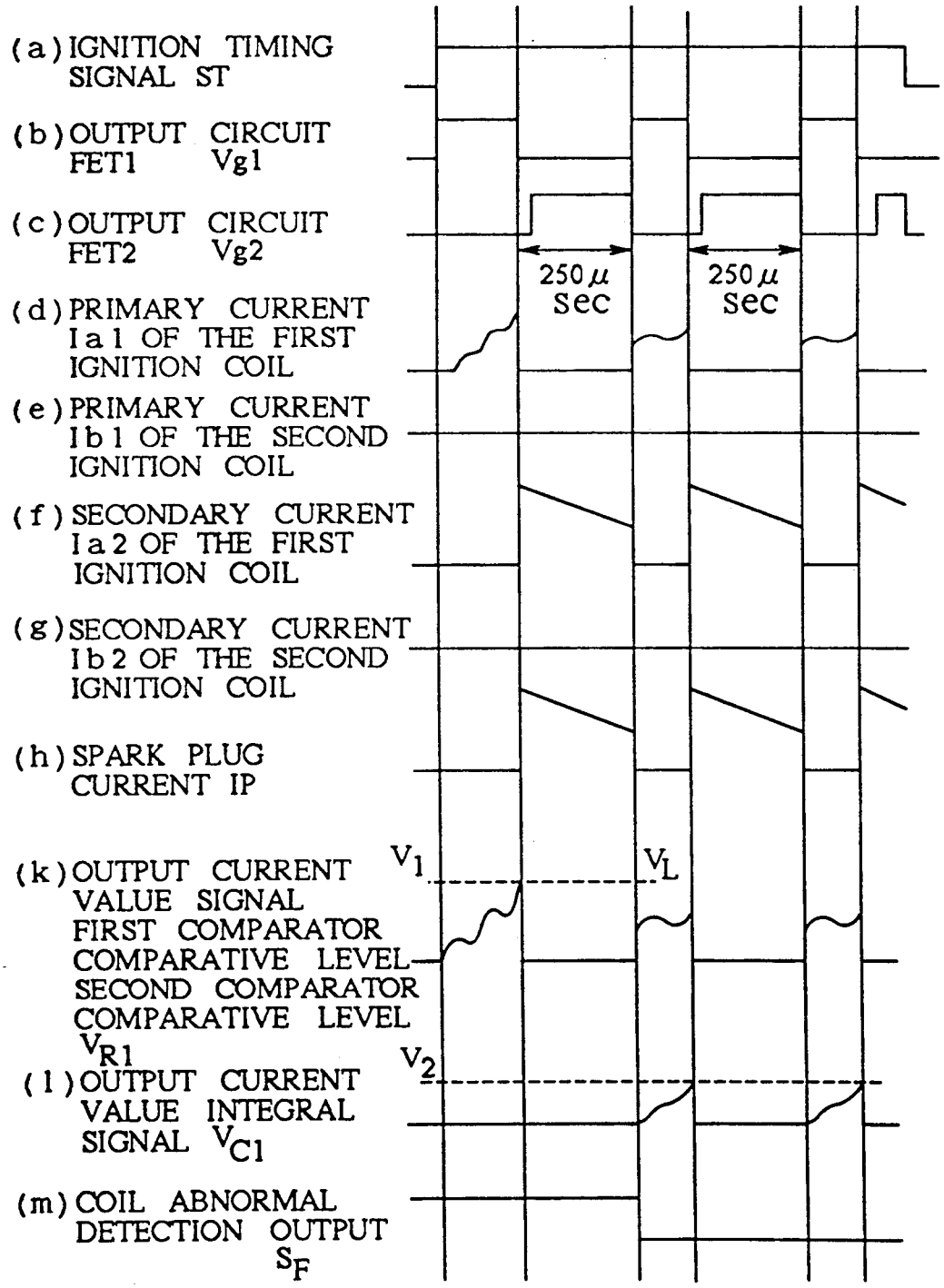
Figure 10:
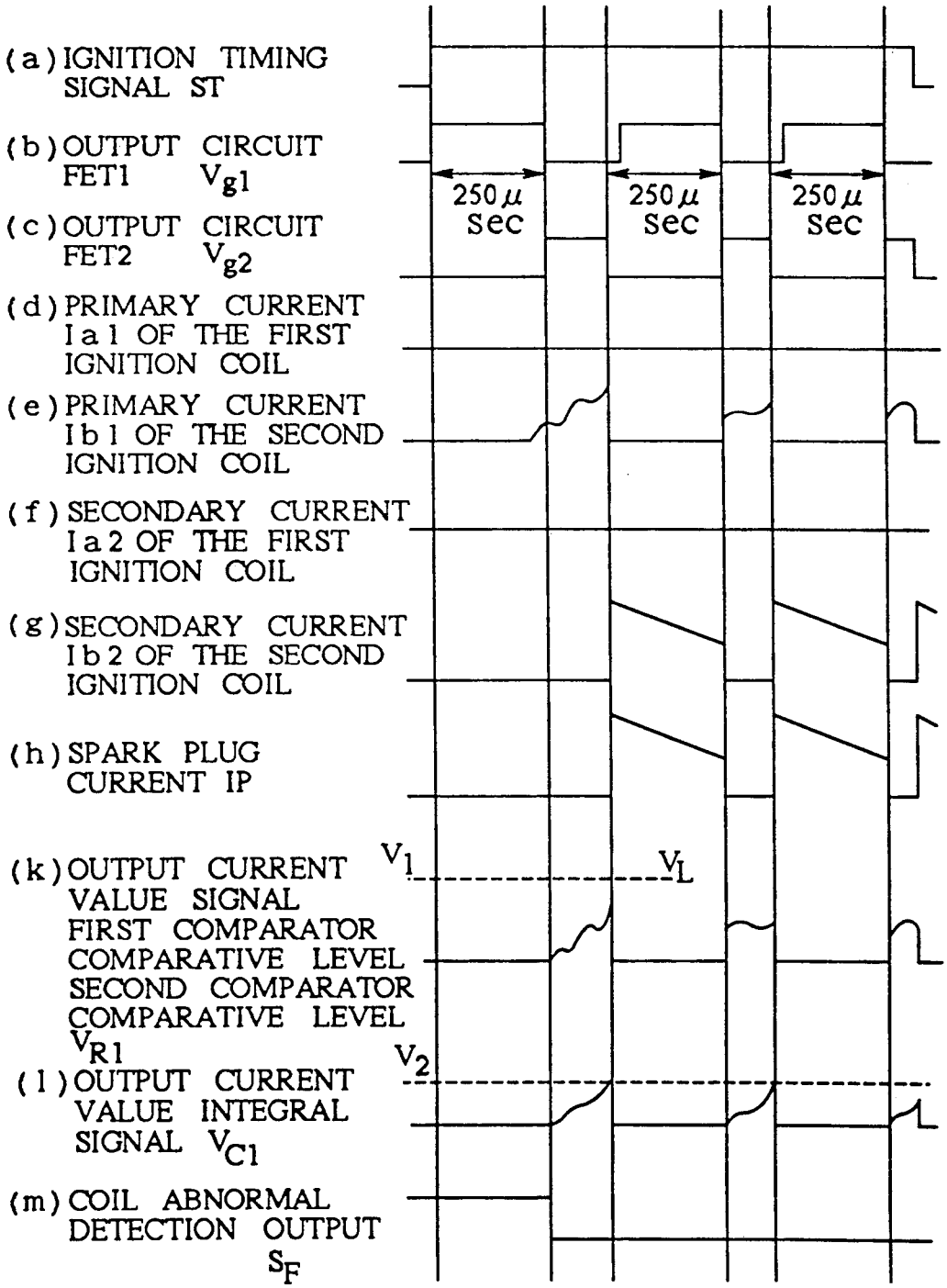

As shown in FIGS. 7 and 8, even when the comparative voltage level V1 is in the high level VH which is to be compared with the output current signal VR1 of the comparator CP1, the output current value signal VR1 can be raised to this high level VH without considerable time lag by means of the primary current of only one ignition coil. The reason is that a current flowing through a single ignition coil is a vibration current which results in scarce difference between the vibration current and the summation of the primary currents of two ignition coils in the required time for reaching a peak value.

The foregoing embodiment of the present invention is provided with two ignition coils each of which can supply the ignition current independently or cooperatively with another and the coils are designed to be operated under any one of the parallel mode, the sequential mode and the single mode can by means of the supply mode changing means of the controller.

In case that the output wave shape changing circuit 34 is selected to be "first choice", the parallel mode can be selected during a period after issue of the ignition timing signal Sr and the sequential mode can be selected after the termination of the foregoing period, resulting in that at an initial stage of the ignition a supply of a large amount of discharging energy and subsequent continuous supply of the discharging energy can be established by which the supply of energy for combustion can be effective and efficient.

An employment of the overlapping duration in the sequential mode enables the prevention of the misfire under an environment where the misfire will often generate upon employment of the conventional ignition manner and differs from the conventional multi-ignition system in that the spark plug is continued to be discharged even while the ignition coil is being stored with discharging energy and in that a large amount of energy can be supplied to the combustion chamber of the engine for a desired duration due to unemployment of a rest period of the ignition. In addition, all energy stored in each ignition coil by supplying thereto the primary current is not to be fully consumed during a supply of the ignition current, which leads to the restore of energy in the ignition coil stored therein a sufficient remaining energy, thereby enabling the realizing of the quick or immediate restore of the energy in the ignition coil.

As for the selections in the output wave shape changing circuit in the embodiment, both of a reliable ignition and and an economy ignition can be selected in such a manner that "first choice" is selected in a cold season or in a cold area and "second choice" is selected in a warm season or a warm area for instance. Each selection is not restricted to a manual one as shown in the foregoing embodiment and can be designed to be an automatic selection by means of a temperature control and so on or to be a fixed selection in such a manner that "first choice" is selected only upon engine initiation.

Obviously, numerous modifications and variations of the present invention are possible in light of the above teachings. It is therefore to be understood that within the scope of the appended claims, the invention may be practised otherwise than as specifically described herein.

What is claimed is:

1. An ignition controlling device, comprising:
a spark plug;
a first ignition coil for supplying an ignition current to the spark plug;
a second ignition coil for supplying an ignition current to the spark plug; and
a controller for controlling the supplies of the currents to the spark plug from the first and second ignition coils;
wherein the controller includes a vibrating current compensating means by which a primary current of the first ignition coil and a primary current of the second ignition coil are set to be flowed out of phase by a half of the vibration cycle of each primary current.

2. An ignition controlling device according to claim 1 wherein the controller includes a sequential mode supply means for supplying ignition currents in series from the first and the second ignition coils to the spark plug.

3. An ignition controlling device according to claim 2 wherein the supply of the ignition current from the second ignition coil is set to be initiated until the supply of the ignition current is terminated.

4. An ignition controlling device according to claim 2 wherein the controller further includes a parallel mode supply means for establishing the parallel supplies of the ignition currents from the first and the second ignition coils and a supply mode changing means for selecting either the parallel mode supply means or the sequential mode supply means.

5. An ignition controlling device according to claim 4 wherein the supply mode changing means is set to select the parallel mode supply means upon issue of an ignition signal and thereafter select the sequential supply mode.

6. An ignition controlling device according to claim 4 and claim 6 the controller further includes a single mode supply means for supplying successive ignition currents from one of the first ignition coil and the second ignition coil in the multi-ignition manner and the single mode supply means is set to be selected by the supply mode changing means when the other of the first ignition coil and the second ignition coil is detected to malfunction.

7. An ignition controlling device according to claim 1 wherein the controller is set to control the primary current of each ignition coil based on an integral value signal of the primary current.

8. An ignition controlling device according to claim 1, wherein the controller further comprises:

means for producing an output current value signal, said output current being a sum of said primary currents of said first and second ignition coils;

means for producing an output current integration value signal;

means for comparing said output current value signal with a first predetermined voltage value and for comparing said output current integration value signal with a second predetermined voltage signal, and for producing respective first and second comparison result signals; and control circuit means, including first and second transistors, for controlling said supplies of the currents to the spark plugs from said first and second ignition coils, respectively, using said first and second comparison result signals.

9. An ignition controlling device, comprising:

a spark plug;

a first ignition coil for supplying an ignition current to the spark plug;

a second ignition coil for supplying an ignition current to the spark plug; and a controller for controlling the supplies of the currents to the spark plug from the first and second ignition coils;

wherein the controller includes parallel control means for controlling a simultaneous flowing of primary currents through said first ignition coil and said second ignition coil; and sequential means for controlling primary currents flowing through said first ignition coil and said second ignition coil such that corresponding secondary currents are out of phase by 180° but have an overlapping portion for a predetermined period of time.

* * * * *